United States Patent [19]

Willis et al.

[11] Patent Number: 4,784,730

[45] Date of Patent: Nov. 15, 1988

[54] CATHODES SUITABLE FOR USE IN ELECTROCHEMICAL PROCESSES EVOLVING HYDROGEN

[75] Inventors: Peter M. Willis, Wallingford; Ralph L. Phillips, Reading, both of England

[73] Assignee: Johnson Matthey Public Limited Company, London, England

[21] Appl. No.: 74,217

[22] Filed: Jul. 16, 1987

[30] Foreign Application Priority Data

Jul. 16, 1986 [GB] United Kingdom ..... 8617325

[51] Int. Cl.[4] ..... C25D 5/10

[52] U.S. Cl. ..... 204/40; 204/46.1; 204/47; 204/47.5; 204/290 R; 204/291; 204/292; 204/293; 427/436

[58] Field of Search ..... 204/98, 128, 40, 47, 204/47.5, 46.1, 290 R, 290 F, 293, 291, 292; 427/436

[56] References Cited

U.S. PATENT DOCUMENTS

| | | | |
|---|---|---|---|
| 4,191,618 | 3/1980 | Coker et al. | 204/98 |
| 4,343,690 | 8/1982 | De Nora | 204/263 |

FOREIGN PATENT DOCUMENTS

| | | |
|---|---|---|
| 0059854 | 2/1982 | European Pat. Off. . |
| 1152911 | 2/1958 | France . |
| 2074190 | 3/1984 | United Kingdom . |
| WO86/04364 | 7/1986 | World Int. Prop. O. . |

*Primary Examiner*—R. L. Andrews

*Attorney, Agent, or Firm*—Cushman, Darby & Cushman

[57] ABSTRACT

A cathode suitable for use in an electrochemical process evolving hydrogen (for example the chloralkali process) in which the cathode comprises an electrically conductive substrate (1) made of a non-ferrous metal or having a coherent coating of non-ferrous metal on which is provided an electrocatalyst (4) comprising platinum and ruthenium and wherein the cathode is made more poison-resistant by a deposition of gold or silver and, optionally, a further deposition of PTFE. The cathode is particularly resistant to poisoning by iron.

9 Claims, 1 Drawing Sheet

CATHODES SUITABLE FOR USE IN ELECTROCHEMICAL PROCESSES EVOLVING HYDROGEN

This invention relates to a cathode suitable for use in an electrochemical process evolving hydrogen and to a process for making such a cathode.

The invention is particularly concerned with cathodes for a process such as the chloralkali process having a platinum group metal electrocatalyst deposited thereon. Such cathodes are described in U.S. Pat. No. 4,414,071 the contents of which are incorporated herein by reference. This type of cathode can also be used in water electrolysis cells and in the electrolysis of other alkali metal hydroxides in which hydrogen is evolved at the cathode.

Problems are encountered in the chloralkali process with the electrocatalyst being poisoned particularly by iron ions which may be present in the raw materials used in the catholyte or are picked up from iron or steel pipework and tanks in the catholyte recycle loop. This can be partly alleviated by purifying the raw materials or by lining the pipework and tanks with a suitable inert material but both of these procedures are expensive.

A conventional steel cathode without any electrocatalyst has an over-potential of around 250–300 mV at a current density of about 2.0 kA/m$^2$ at around 90° C. A nickel cathode with a platinum-ruthenium electrocatalyst, as described in U.S. Pat. No. 4,414,071, has an initial over-potential of around 50–100 mV under similar conditions but this rapidly rises to over 150 mV if the cathode is subjected to iron poisoning. Broadly speaking, it would thus be desirable to maintain the hydrogen over-potential of the cathode under similar conditions within the range 50–100 mV despite the presence of iron ions.

European Patent Specification No. 0059854 and PCT Patent Specification No. WO 86/04364 describe cathodes having an electrocatalyst of one or more platinum group metals and a deposit of PTFE particles which increase the poison resistance of the cathode to iron ions.

According to a first aspect of the invention there is provided a cathode suitable for use in an electrochemical process evolving hydrogen comprising an electrically conductive substrate made of a non-ferrous metal or having a coherent, non-porous coating of non-ferrous metal and an electrocatalyst comprising a deposition of platinum and ruthenium or precursors thereof on the conductive substrate and a deposition of at least one of the metals gold and silver whereby the poison-resistance of the cathode to iron is increased as compared to a similar cathode without the gold or silver deposition.

According to a second aspect of the invention, there is provided a process for making a cathode as described above comprising: depositing platinum and ruthenium or precursors thereof onto an electrically conductive substrate made of a non-ferrous metal or having a coherent, non-porous coating of non-ferrous metal and the deposition of at least one of the metals gold and silver.

The deposition of gold onto a cathode suitable for use in electrochemical processes evolving hydrogen is disclosed in French Patent Specification No. 1152911 which describes a method of producing an activated coating for reducing the hydrogen over-potential of electrolytic hydrogen generator cathodes. The method involves the deposition of one or a plurality of the metals Platinum, Rhodium, Palladium, Osmium and Iridium by immersion of an iron cathode in an aqueous solution of the precious metal salts. The incorporation of small quantities of gold in the activated coating is also said to make the coating more durable and the hydrogen over-potential lower.

However, this prior art does not address the problem of poisoning by iron. Indeed, it suggests the use of an iron substrate for the cathode and the iron released from this following attack by the caustic electrolyte is likely to exacerbate the problem of iron poisoning.

Tests have been carried out on the coatings described in French Patent Specification No. 1152911. A mild steel plate was shotblasted to roughen its surface and then immersed for 5 minutes in a solution containing 0.5 g/l of platinum as chloroplatinic acid and 0.1 g/l of gold as chlorauric acid. The sheet was then dried and tested in the same manner as described below in relation to Example 1 but with 8.6 ppm of iron in the catholyte to simulate iron poisoning. The initial over-potential was measured as 184 mV which shows a decrease compared to 280 mV for a similar shotblasted mild steel plate without any coating of platinum or gold. This indicates that a significant reduction in initial overpotential was achieved with the gold/platinum coating although this was less than that found for a ruthenium/platinum coating on a nickel substrate. However, the overpotential of the coating rose very rapidly (within twenty-four hours) to around 260 mV and stayed there for the duration of the experiment (in this case 1 week) indicating that the electrocatlayst was seriously poisoned by the presence of iron in the catholyte.

Preferred features of the invention will be apparent from the following description and from the subsidiary claims of the specification.

The invention will now be described, merely by way of example, with reference to the following drawings and examples:

Example 1 relates to a cathode with an electrocatalyst coating of platinum, ruthenium and gold according to one embodiment of the invention;

Example 2 relates to a cathode with an electrocatalyst coating of platinum, ruthenium, gold and PTFE according to a modified form of the first embodiment;

Example 3 relates to a cathode with an electrocatalyst coating of platinum, ruthenium and silver according to a second embodiment of the invention; and Comparative Example A relates to a cathode similar to that of Example 1 but without the gold.

Figure 1:
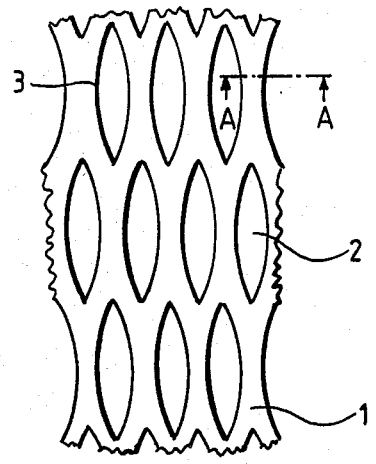
FIG. 1 shows part of a cathode according to one form of this invention.

FIG. 1 shows part of a cathode according to one form of the invention. The cathode comprises a nickel substrate 1 in the form of an expanded mesh made by stretching an apertured sheet of nickel. This type of mesh is widely used for cathodes of chloralkali cells and comprises a plurality of approximately elliptical apertures 2 having a number of very sharp edges 3.

Figure 2:
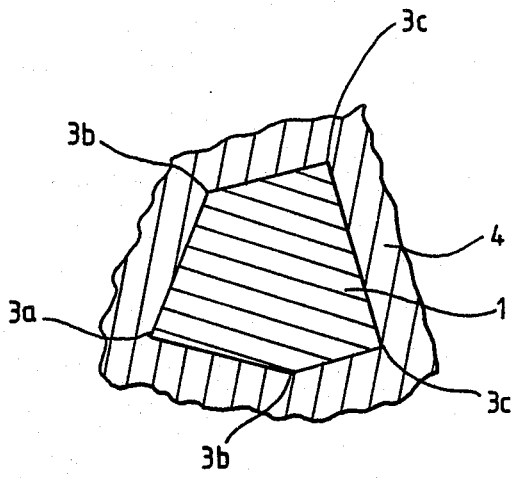
FIG. 2 shows (on a larger scale) a section of the cathode taken on the line A—A of FIG. 1.

The cross-section shown in FIG. 2 shows the sharp edges 3 of the apertures 2 more clearly. One edges 3*a* subtends an internal angle of about 60°, two other edge 3*b* angles of about 130° and two further edges 3*c* angles of about 90°. An electrocatalyst coating 4 is shown on the substrate 1.

It has been found that the performance of the electrocatalyst is enhanced by the use of such a foraminate substrate having many sharp edges and points. Other examples of this type of substrate are plates having apertures and/or recesses stamped therein, and which may also have been crimped, and substrates formed by woven or knitted wire.

EXAMPLE 1

This Example illustrates the preparation and performance of a first embodiment of a cathode according to the invention. In this Example, the cathode is provided with an electrocatalyst coating of platinum, ruthenium and gold.

An apertured nickel substrate similar to that described in relation to FIGS. 1 and 2 was used in preparing the cathode. The substrate comprised about 1 $cm^3$ of nickel (as determined by immersion in water) but occupied a space of about 3 $cm^3$ and contained a total of about 1000 mm of sharp edges. The metal surrounding the apertures 2 was about 1 mm thick. The substrate was grit blasted to roughen its surface, rinsed under a jet of high pressure water to flush away loose particles, washed in acetone to remove any grease, treated with 2 N hydrochloric acid for one minute and then washed with de-ionised water.

Immediately after the washing with de-ionised water, an electrocatalyst was provided on the activated substrate by immersing the substrate in a solution of chloroplatinic acid and ruthenium trichloride in de-ionised water maintained at room temperature for 20 minutes. The solution contained approximately 2 g/l of platinum ions and approximately 2 g/l of ruthenium ions. During the immersion a mixture of platinum and ruthenium spontaneously deposited onto the substrate to produce an electrocatalyst coating of about 5.2 $g/m^2$ comprising a mixture of platinum and ruthenium in a weight ratio of from 3:1 to 4:1. The substrate bearing this electrocatalyst coating was removed from the solution, washed in warm (60° C.) de-ionised water for one minute and allowed to dry in air. An adherent, durable platinum-ruthenium coating was thus formed on the substrate. Coating weights of between 0.1 and 20 $g/m^2$ can be formed by this method by a suitable variation of the parameters.

Gold was then deposited by immersing the substrate bearing the electrocatalyst coating in a solution of chlorauric acid in de-ionised water at room temperature for 20 minutes. The solution contained approximately 0.06 g/l of gold ions. During the immersion, gold was spontaneously deposited thereby completing the electrocatalytic coating. The gold deposit amounted to about 0.16 $g/m^2$ which is around 3.1 wt % of the combined weight of the deposited platinum and ruthenium. Examination of the coating by secondary electron microscopy indicated that the gold is deposited in discrete centres so that a nodular growth is formed on top of the platinum-ruthenium coating. The cathode was finally washed in de-ionised water and allowed to dry.

The cathode was then tested in a poisoned catholyte of a type similar to that occuring in the chloralkali process in the manner described below:

The cathode prepared in Example 1 was used as the cathode of an electrochemical half-cell comprising a cathode compartment designed to simulate that of a static chloralkali cell and wherein the catholyte comprised a 35 wt % solution of sodium hydroxide maintained at 90° C. To simulate iron poisoning, the catholyte also initially contained approximately 2.5 ppm of iron ions as iron chloride. The current density employed was 2.0 $kA/m^2$ and the hydrogen over-potential of the cathode was measured using a conventional Luggin tube linked to a standard dynamic hydrogen electrode. The overpotential was measured at intervals during a period of operation and remained at a level below 100 mV as shown in Table 1. It can be seen that there was very little change in the hydrogen-overpotential over a period of 20 days indicating that the cathode had good resistance to poisoning by iron.

EXAMPLE 2

This Example illustrates how the performance of a cathode as prepared in Example 1 can be further improved by incorporating an organic polymer into the electrocatalytic coating.

The procedure of Example 1 was repeated except that the solution containing platinum and ruthenium ions also contained 20 g/l of spheroidal PTFE particles having a number average maximum dimension of 0.2 μm. The immersion of the substrate into the solution for 20 minutes at room temperature caused a spontaneous deposition of PTFE particles as well as the deposition of platinum and ruthenium. About 0.03 $cm^3$ of PTFE was deposited per square meter of the surface area of the substrate which is about $0.05\times10^{13}$ particles/$m^2$. A gold deposit waws then formed in the same manner as in Example 1 and dthe cathode was tested in a similar manner tothe tests conducted in Example 1. The results are shown in Table 1. It can be seen that there is small gradual increase in hydrogen-overpotential over a period of 20 days but that over this period the overpotential remained below 100 mV which, as indicated above, is good by the standards of the chloralkali industry.

EXAMPLE 3

This Example illustrates the use of silver as an alternative to gold in a cathode similar to that prepared in Example 1. The procedure of Example 1 was repeated except that in order to produce a deposit of silver instead of gold, the solution of chlorauric acid was replaced by a solution of silver nitrate containing 0.06 g/l of silver ions. The silver deposit formed amounted to about 0.1 $g/m^2$ which is around 1.9 wt % of the combined weight of the platinum and ruthenium in the coating. The cathode was tested in a similar way to that prepared Example 1 and the results are again shown in Table 1 from which it can be seen that the hydrogen-overpotential remained at a level well below 100 mV after 20 days showing that this cathode also had good resistance to poisoning by iron.

COMPARATIVE EXAMPLE A

The procedure of Example 1 was repeated except that the deposition of gold was omitted. The cathode was tested as before and the hydrogen-overpotentials measured are shown in Table 1. It can be seen that after only eight days the hydrogen-overpotential had reached 150 mV which indicates that the electrocatalyst had been seriously poisoned by the presence of iron in the catholyte.

The platinum-ruthenium coating can be deposited by other techniques such as spraying so long as a sufficiently durable, adherent coating is formed on the substrate. The platinum and ruthenium may be deposited in the form of precursors thereof such as the oxides which are then substantially reduced to the metallic form once they are used in the electrochemical process, for instance, in a chloralkali cell. It is believed that the process described in European Patent Specification No. 0129374 may be an example of an alternative way of forming the platinum-ruthenium coating. Although this describes a coating of platinum and ruthenium oxide, tests have shown this to comprise substantially platinum and ruthenium in the metallic form, at least after use in a chloralkali cell.

The gold or silver may be deposited by most standard deposition techniques such as sputter coating, electroplating, painting or spraying. Sputtering has the advantage that the amount of gold or silver deposited can be closely controlled and enables the required coating weight to be deposited in about 1 minute. Gold can also be deposited by means of a colloidal suspension of fine metallic particles. However, the preferred process comprises immersing the cathode in a solution containing gold or silver ions as described above, or spraying the solution onto the cathode, so that spontaneous deposition of gold or silver occurs.

The mechanism for the deposition of the gold or silver is not fully understood but for the exchange deposition process described it is believed that the gold or silver is deposited onto the platinum-ruthenium coating and nickel from the substrate goes into solution. As mentioned above, the gold or silver tends to deposit in discrete centres and secondary electron micrographs have indicated a nodular growth of silver or gold on top of the platinum-ruthenium coating. However, some of the gold may also deposit onto exposed portions of the nickel substrate and, in any case, the morphology of the coating is likely to alter during use due to its role in catalysing the reaction at the cathode and migration of the various species involved.

It has been found that substantial improvements in poison-resistance can be achieved with quite small deposits of gold. For example, the amount of gold deposited may be from 0.1 to 11 wt % (and preferably 1 to 6 wt %) of the total weight of platinum and ruthenium in the electrocatalyst coating (including the metal content of any precursor). Smaller amounts tend to be ineffective whereas heavier deposits do not adhere well to the cathode. Silver is effective in similar or even smaller amounts such as 1 to 2 wt % of the platinum-ruthenium coating.

The non-ferrous electrically conductive substrate should comprise material which has adequate electrical conductivity and corrosion resistance and which can receive an adherent deposit of platinum and ruthenium. Preferably, the substrate comprises a metal having an electrode potential below that of platinum and, of these, nickel is preferred because of its widespread acceptance for use in the chloralkali process. Alternatively, the substrate may comprise a core, for instance of stainless steel, provided with a coherent, non-porous coating of a non-ferrous metal such as nickel.

As illustrated by Example 2 above, the poison-resistance of cathodes can be further improved by providing the cathode with an electrocatalyst in which the platinum and ruthenium are mixed with particles of an organic polymer as well as the gold and/or silver deposit. Such cathodes are conveniently made by choosing an electrically conductive substrate comprising at least one metal (for example nickel) having an electrode potential below that of platinum, then contacting the substrate with a solution containing platinum and ruthenium and also containing particles of an organic polymer. This causes a spontaneous deposition of both the platinum and ruthenium and the organic polymer particles. The substrate coated in this way is then contacted with a solution containing ions of gold and/or silver whereby a spontaneous deposition of gold and/or silver occurs. Alternatively, the deposition of the platinum, ruthenium, the particles of organic polymer and the gold and/or silver may be produced simultaneously by contacting the substrate with a solution which contains ions of platinum, ruthenium and gold and/or silver as well as particles of the organic polymer although there is a tendency in this method for the plating solution to become unstable resulting in the precipitation of one or more species.

The polymer used may be an organic homopolymer or copolymer or mixture of polymers in the form of spherical or or spheroidal particles preferably capable of forming a lyophobic dispersion in an aqueous solution. Polytetrafluoroethylene (PTFE) is the preferred polymer because it has a high softening temperature and it readily forms an aqueous dispersion of spheroidal particles. Preferably, the aqueous dispersion contains from 0.5 to 40 g/liter of PTFE particles. The number average size of the particles is preferably from 0.05 to 20 μm and the polymer is preferably deposited in amounts as low as from 0.0005 to 0.3 $cm^3/m^2$ of the surface area of the substrate prior to any surface roughening treatments. It is preferred that the organic particles form a monolayer and that not more than 30% of the particles should be contiguous so the number of particles deposited is preferably from $0.1\times10^{13}$ to $5\times10^{13}/m^2$ of the surface area of the substrate before roughening. This method of depositing PTFE particles is similar to that described in PCT Patent Specifications WO 86/04364 which is incorporated herein by reference.

It should be noted that the UK Patent No. 2074190B describes and claims a cathode provided with a platinum-ruthenium electrocatalyst.

TABLE 1

| Example No of days of testing | Overpotential in mV after various periods (days) of testing | | | | | | | |
|---|---|---|---|---|---|---|---|---|
| | 0 | 1 | 2 | 5 | 8 | 10 | 15 | 20 |
| A | 30 | 42 | 43 | 110 | 150 | — | — | — |
| 1 | 92 | 90 | 90 | 82 | 84 | 94 | 86 | 90 |
| 2 | 24 | 26 | 34 | 38 | 44 | 34 | 62 | 48 |
| 3 | 60 | 58 | 88 | 60 | 64 | 57 | 45 | 78 |

We claim:

1. A cathode suitable for use in an electrochemical process evolving hydrogen comprising an electrically conductive substrate made of a non-ferrous metal or having a coherent, non-porous coating of non-ferrous metal and an electrocatalyst comprising a deposition of platinum and ruthenium or precursors thereof on the conductive substrate and a deposition of at least one of the metals gold and silver whereby the poison-resistance of the cathode to iron is increased as compared to a similar cathode without the gold or silver deposition.

2. A cathode as claimed in claim 1 wherein the amount of the metals gold and silver deposited is in the range of 0.1 to 11 wt % of the total weight of platinum group metal (including the metal content of any precursor).

3. A cathode as claimed in claim 1 or claim 2 wherein the substrate comprises nickel.

4. A cathode as claimed in any of claims 1 to 3 wherein the electrocatalyst also comprises particles of an organic polymer.

5. A cathode as claimed in claim 4 wherein the organic polymer is a polytetrafluoroethylene.

6. A process for making a cathode according to claim 1 depositing platinum and ruthenium or precursors thereof onto an electrically conductive substrate made of a non-ferrous metal or having a coherent, non-porous coating of non-ferrous metal and the deposition of at least one of the metals gold and silver.

7. A process as claimed in claim 6 in which the platinum and ruthenium are deposited by exchange deposition.

8. A process as claimed in claim 6 or 7 in which the gold and/or silver are deposited by exchange deposition.

9. A process as claimed in and of claims 6, 7 and 8 in which the platinum and ruthenium are deposited first followed by deposition of the gold and/or silver.

* * * * *